US006998578B2

(12) United States Patent
Tsuji et al.

(10) Patent No.: US 6,998,578 B2
(45) Date of Patent: Feb. 14, 2006

(54) BAKING SYSTEM FOR PLASMA DISPLAY PANEL AND LAYOUT METHOD FOR SAID SYSTEM

(75) Inventors: Hiroyasu Tsuji, Sennan-gun (JP); Makoto Morita, Nisinomiya (JP); Masanori Suzuki, Osaka (JP); Hihuo Noiri, Hashima-gun (JP); Michiro Aoki, Oobu (JP); Takahiro Takeda, Nagoya (JP)

(73) Assignees: NGK Insulators, Ltd., Nagoya (JP); Matsushita Electric Industrial Co., Ltd., Kadoma (JP)

( * ) Notice: Subject to any disclaimer, the term of this patent is extended or adjusted under 35 U.S.C. 154(b) by 273 days.

(21) Appl. No.: 10/421,729

(22) Filed: Apr. 24, 2003

(65) Prior Publication Data

US 2003/0232562 A1 Dec. 18, 2003

(30) Foreign Application Priority Data

Apr. 30, 2002 (JP) ..... 2002-128082

(51) Int. Cl.
*F27D 11/00* (2006.01)

(52) U.S. Cl. ..... 219/388; 219/387; 219/389; 219/390; 219/391; 219/395

(58) Field of Classification Search ..... 219/387–391, 219/395

See application file for complete search history.

(56) References Cited

U.S. PATENT DOCUMENTS 6,018,144 A * 1/2000 Vogt et al. ..... 219/388
6,204,483 B1 * 3/2001 Fair et al. ..... 219/388

* cited by examiner

*Primary Examiner*—Shawntina Fuqua
(74) *Attorney, Agent, or Firm*—Oliff & Berridge, PLC

(57) ABSTRACT

A baking system for a plasma display panel which comprises a clean room 1 and a baking furnace having an upper passage 11 for conveying a plasma display panel glass substrate 5 during baking from an inlet 15 of the furnace 3, and a lower passage 13 for conveying the baked substrate 5 in the upper passage 11 towards an outlet of the furnace 3, both of the inlet and the outlet being provided at the same end of the furnace 3, characterized in that only the inlet 15 and the outlet 17 are connected to a clean room 1, while keeping a body thereof outside the clean room 1. Also, there is disclosed a layout method for such a baking system.

4 Claims, 7 Drawing Sheets

BAKING SYSTEM FOR PLASMA DISPLAY PANEL AND LAYOUT METHOD FOR SAID SYSTEM

BACKGROUND OF THE INVENTION

1. Field of the Invention

The present invention relates to a baking system for plasma display panel and a layout method for said system that is used for baking a glass substrate of a plasma display panel.

2. Description of the Related Art

In recent years, progress has been made steadily to put to practical use large screen flat panel displays (hereinafter referred to as "FPDs") that can be used as wall-mounted televisions or multimedia displays. For such a large screen FPD, a plasma display panel (hereinafter referred to as "PDP") has been nominated as the most promising candidate, since it has various merits in terms of such a quality that it is of a self-luminescence type and has a wide visual field angle and its displaying quality is high, but also in terms of such a production aspect that its manufacturing process is simple and an increase of size can be easily achieved.

The PDP is produced by forming various components such as electrodes, dielectric constant, and phosphors in order on the surface of each of large-sized glass substrates called front glass and rear glass according to a thick film forming method that repeats processes of printing, drying, and baking a plurality of times, and by finally sealing a pair of the resultant front glass and the resultant rear glass.

Baking of the PDP glass substrates has been performed according to a method wherein, for preventing failure or deterioration of products due to adhesion of foreign matter, baking furnaces 3 are housed within a clean room 1 as shown in FIG. 7, a plural number of PDP glass substrates placed on setters is conveyed into each baking furnace 3 and, while conveying them in one direction using conveying means such as rollers, the PDP glass substrates are subjected to preheating, soaking, and temperature-lowering treatments according to a predetermined temperature curve.

However, inasmuch as a very large space is required for housing the whole body of a plural number of baking furnaces 3 within the clean room 1 as described above, initial cost and running cost of the clean room 1 become enormous. Further, since a maintenance operation of each baking furnace 3 should be performed within the clean room 1, there has been a problem that dust that is generated upon performing the maintenance operation is scattered in the clean room 1 to adversely affect other installations arranged in the clean room 1.

SUMMARY OF THE INVENTION

The present invention has been made under those circumstances and has an object to provide a baking system for plasma display panel and a layout method for said system that can largely reduce a space of a clean room necessary for baking PDP glass substrates, as compared with the conventional system or conventional layout method as described above, and that can prevent contamination of the clean room due to dust generated upon performing the maintenance operation of the baking furnace.

According to the present-invention, there is provided a_baking system for plasma display panel comprising a baking furnace for a plasma display panel; said furnace having an upper passage for conveying a plural number of plasma display panel glass substrates placed on respective setters while baking the substrates during conveying and a lower passage for conveying thus baked plasma display panel glass substrates during conveying in the upper passage in a direction opposite to the conveying direction of the substrates for baking in the upper passage, and further being provided with an inlet for introducing the plasma display panel glass substrates into the upper passage and an outlet for carrying out the baked plasma display panel glass substrates from the lower passage at the same end thereof, and a clean room, characterized in that only the inlet and the outlet are connected to the clean room, but a body of the baking furnace is disposed outside the clean room. Furthermore, there is provided with a layout method for said baking system thus constructed.

BRIEF DESCRIPTION OF THE DRAWINGS

FIGS. 3A and 3B are explanatory diagrams showing the state of arrangement of an exhaust hood and a shutter, wherein FIG. 3A is a plan view and FIG. 3B is a perspective view;

FIGS. 5A and 5B are explanatory diagrams showing one example in which a side wall portion of a thermal shield plate is formed as an open/close door, and a mounting plate and a control panel are attached to the back side thereof, wherein FIG. 5A shows the state where the open/close door is closed while FIG. 5B shows the state where the open/close door is open;

DESCRIPTION OF THE PREFERRED EMBODIMENT

Figure 2:
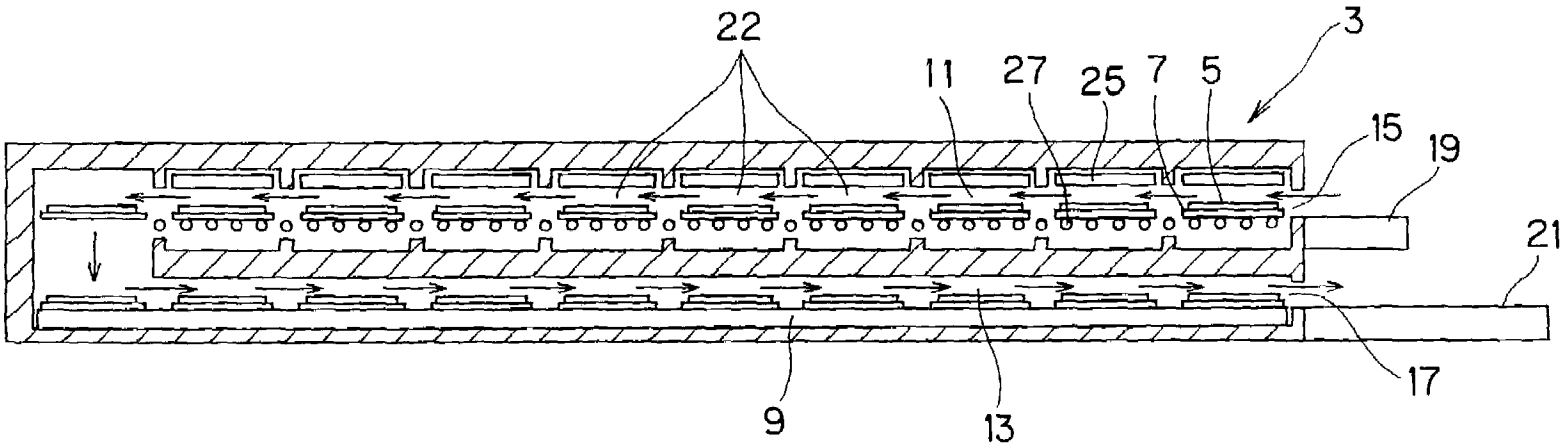
FIG. 2 is an explanatory diagram showing a schematic structure of the baking furnace that is used in the layout method of the present invention.

FIG. 2 is an explanatory diagram showing a schematic structure of a baking furnace 3 usable for the system for baking plasma display panel glass substrates and the layout method for said system according to the present invention. The baking furnace 3 comprises an upper passage 11 in which PDP glass substrates 5 placed on setters 7 are baked while being conveyed therealong, and a lower passage 13 provided with a conveyer 9 for conveying the PDP glass substrates 5 baked in the upper passage 11 in a direction opposite to a conveying direction during baking in the upper passage 11 for taking out from the setter.

An inlet 15 for conveying the PDP glass substrates 5 into the upper passage 11, and an outlet 17 for taking out the baked PDP glass substrates 5 from the setters on the lower passage 13 are provided at the same axial end of the baking furnace 3, so that the conveying-in operation and the taking-out operation can be carried out in substantially the same place.

At front portions of the inlet 15 and the outlet 17, there are respectively provided a loader 19 for placing the PDP glass substrates 5 on the setters 7 before introducing them into the baking furnace 3, and an unloader 21 for removing the baked PDP glass substrates 5, which are carried out from the outlet 17, from the setters 7.

In the baking process of the PDP glass substrate 5 using the thus constructed baking furnace 3, the PDP glass substrate 5 is first placed on the setter 7 in the loader 19 located in front of the inlet 15, then conveyed into the upper passage 11 via the inlet 15. In general, the upper passage 11 comprises a plurality of heating chambers 22 that are defined in the substrate conveying direction (longitudinal direction of the baking furnace 3), and each heating chamber 22 is kept at a predetermined temperature by heating means such as an electrical heater 25.

The PDP glass substrate 5 introduced into the upper passage 11 is, while being placed on the setter 7, continuously or intermittently conveyed by conveying means such as rollers 27 and, while being conveyed, is subjected to heat treatments (baking) in the order of preheating, soaking, and lowering of temperature according to a predetermined temperature curve.

Incidentally, "intermittently conveyed" means a conveying method that repeats an operation such that a PDP glass substrate on placed on one setter in the upper passage is stopped and subjected to a heat treatment for a predetermined time in an nth heating chamber from the side of an inlet of a baking furnace, then the PDP glass substrate is moved into an (n+1)th adjacent heating chamber from the side of the inlet as quick as possible where the PDP glass substrate is again stopped and subjected to a heat treatment for a predetermined time.

The PDP glass substrate 5 thus baked in the upper passage 11 is moved into the lower passage 13 at the other axial end of the baking furnace 3 remote from the inlet 15, then conveyed back in the direction opposite to the conveying direction during baking in the upper passage 11, then taken out together with the setter to the exterior of the baking furnace 3 from the outlet 17 provided at the axial end of the baking furnace 3 where the inlet 15 is also provided, and finally removed from the setter 7 in the unloader 21 located in front of the outlet 17.

Figure 1:
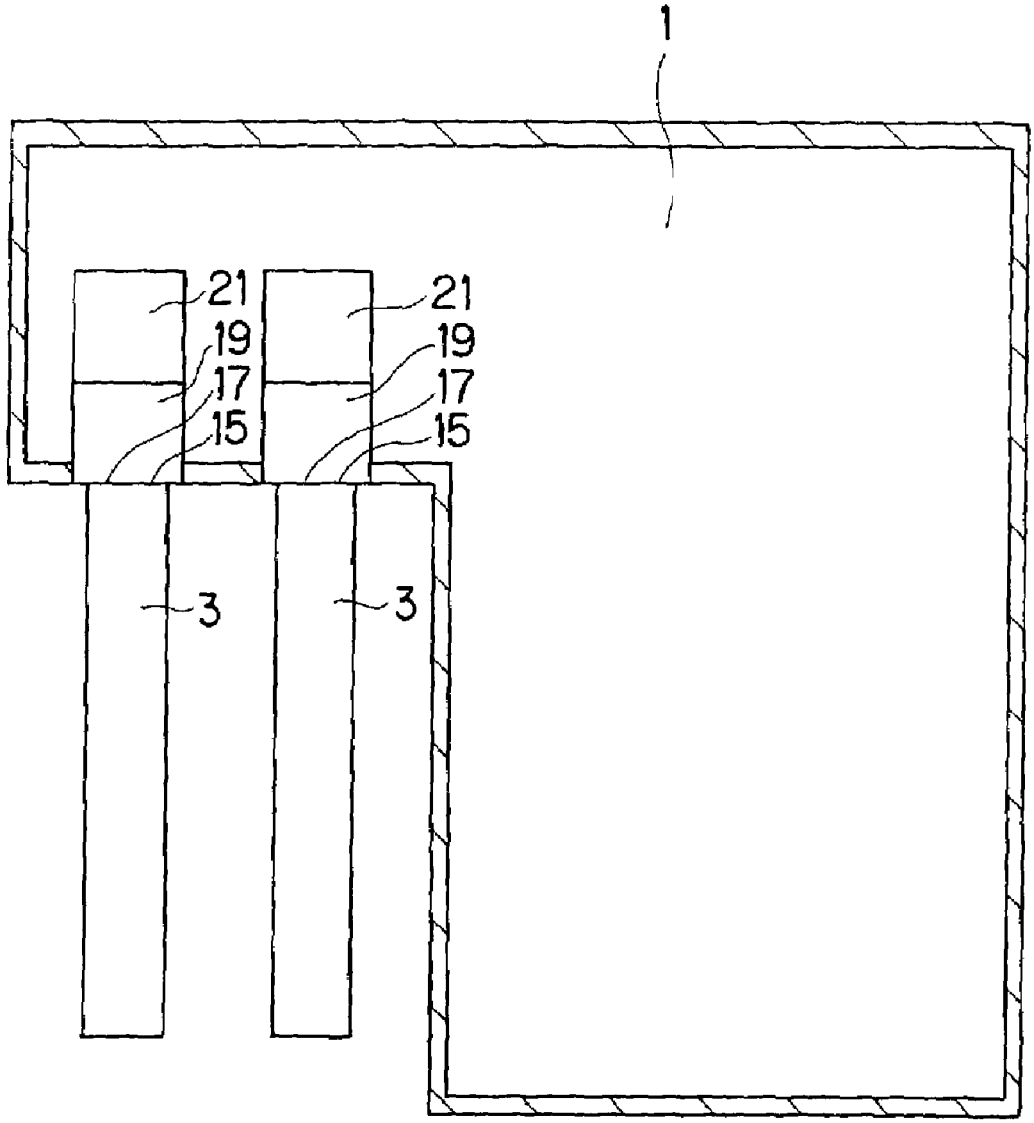
FIG. 1 is an explanatory diagram showing a layout method for a baking furnace for a plasma display panel according to the present invention.

As shown in FIG. 1, the layout method of the present invention is characterized in that the baking furnace 3 having the foregoing structure is arranged such that only the inlet 15 and the outlet 17 are connected air-tightly to the clean room 1, while the body of the baking furnace 3 is placed outside the clean room 1. In the baking furnace 3 having the structure above-mentioned, it is rather easy to form the furnace body excluding the inlet 15 and the outlet 17 to have an airtight structure. Therefore, if only the inlet 15 and the outlet 17 serving as openings leading to the furnace exterior are connected to the clean room 1, even if the furnace body is placed outside the clean room 1, the baking process for the PDP glass substrates can be performed under a clean environment.

By placing the furnace body outside the clean room 1 as described above, a space of the clean room 1 can be largely reduced and thus the initial cost and running cost of the clean room 1 can also be largely reduced, as compared with the conventional system and the conventional layout method for said system in which the whole bodies of all the baking furnaces 3 are housed within the clean room 1. Further, since the maintenance operation of the baking furnace 3 can be performed outside the clean room 1, it is possible to prevent contamination of the clean room 1 due to dust generated upon performing the maintenance operation.

On the other hand, for the purpose of preventing invasion of the outside air, an internal pressure of the clean room 1 is normally set higher than an external pressure. According to the system for baking plasma display panel and the layout method for said system of the present invention, inasmuch as the body of the baking furnace 3 is located outside the clean room 1, air flows are generated against an opening portion of the inlet 15 and an opening portion of the outlet 17 from within the clean room 1 and, in particular, the air flow against the opening portion of the inlet 15 adversely affects temperature distribution of the heating chambers near the inlet 15 where preheating is implemented.

Figure 3A:
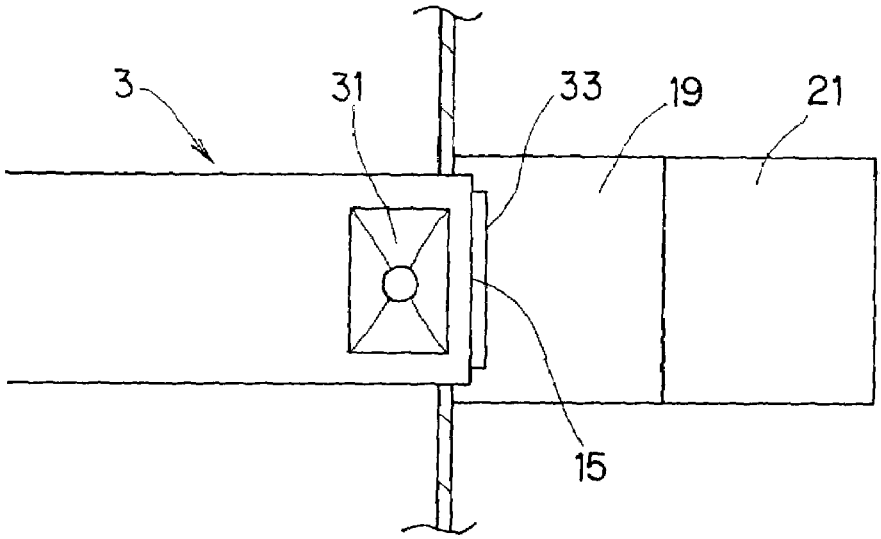
Figure 3B:
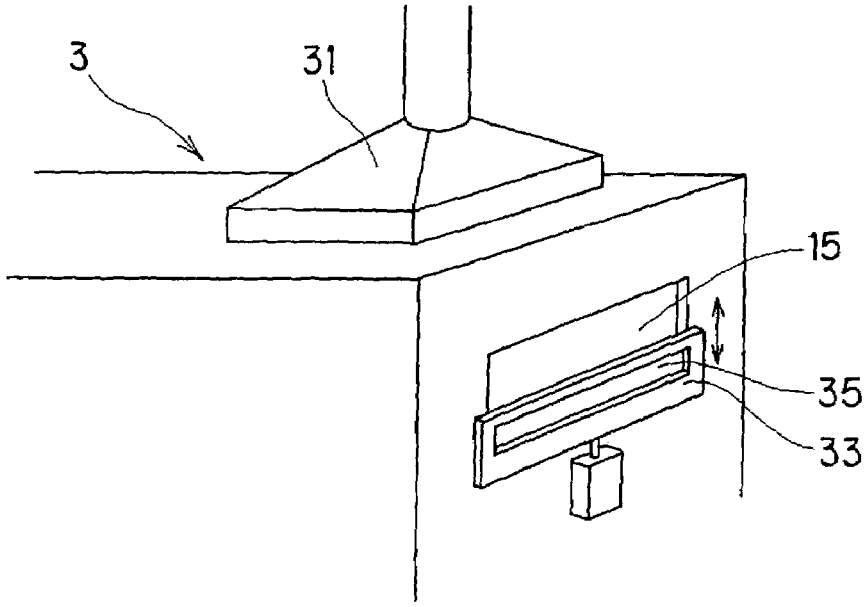

In view of this, when applying the present invention, as shown in FIGS. 3A and 3B, it is desirable that an exhaust hood 31 is provided in the neighborhood of the inlet 15 of the upper passage 11 for exhausting the air entering from the clean room 1 to the furnace exterior, and that a shutter 33 having an opening portion 35 narrower than the opening portion of the inlet 15 is provided so as to suppress entry of the air into the baking furnace 3 by closing the inlet 15 using the shutter 33 during a time other than required to make an opening as small as possible.

In the baking of the PDP glass substrates 5 using the baking furnace 3 having the structure above-mentioned, one circuit line is formed by the loader 19 for placing the substrates 5 on the setters 7, the upper passage 11 for baking the substrates 5, the lower passage 13 for conveying back the baked substrates 5, and the unloader 21 for removing the substrates 5 from the setters 7. Normally, the foregoing baking process is repeatedly performed, so that the setters 7 are continuously moved on such a circuit line.

Then, when such a setter that can not achieve a normal conveyed state due to deterioration such as warp or deformation thereof is found among the setters moving on the circuit line, it is necessary to take out that setter to the exterior of the circuit line, and instead, introduce a new setter on the circuit line.

In general, the setters 7 are assigned individual ID numbers, respectively, and detection means for detecting the ID numbers is disposed at a specific place within the circuit line. Conventionally, an ID number of a deteriorated setter 7 is detected and registered by the detection means and, when the setter 7 assigned that ID number moves on the circuit line to reach the inlet 15, that setter 7 is removed from the circuit line at the inlet 15 and a substitute setter is introduced on the circuit line.

However, since abrasion powder caused by friction between itself and the conveying means is adhered to the setter 7 that is removed from the circuit line, if removal of the deteriorated setter 7 is performed at the inlet 15, the degree of cleanness in the neighborhood of the inlet 15 is lowered so that the abrasion powder adheres to the PDP glass substrates 5. Further, since there are provided material handling devices such as the loader 19, the unloader 21, and so on near the inlet 15, there is substantially no degree of freedom for a space for arranging an apparatus that removes and introduces the setters 7.

Therefore, for solving such inconveniences, it is desirable that the PDP baking furnace used in the layout method of the present invention is provided with a carry-out carry-in mechanism for conveying a setter in a direction perpendicular to the conveying direction of the return conveyer so as to carry out a setter on the return conveyer to an exterior space of the furnace within the clean room and carry in a setter onto the return conveyer from an exterior space of the furnace within the clean room.

Figure 4:
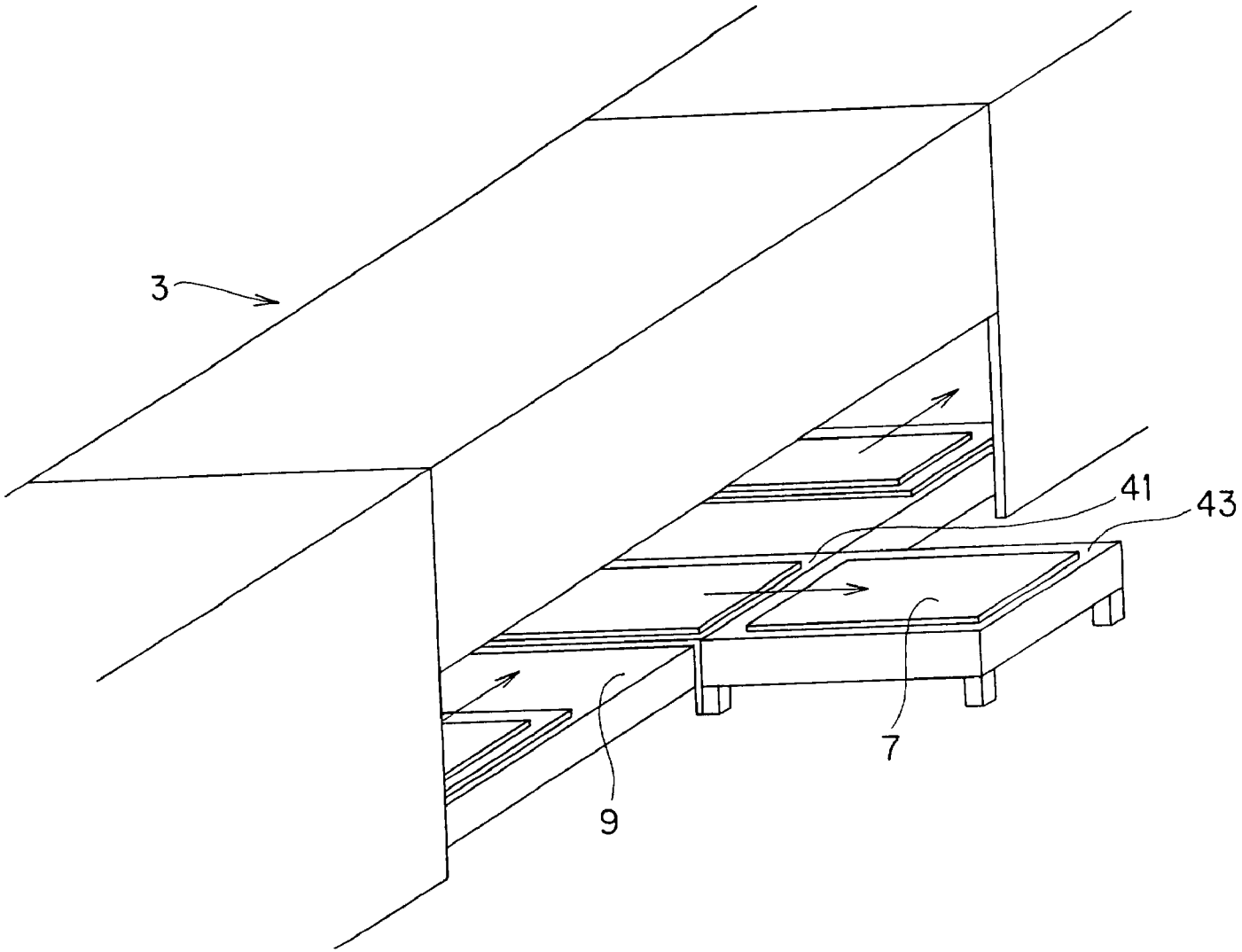
FIG. 4 is an explanatory diagram schematically showing one example of a carry-out carry-in mechanism.

FIG. 4 is an explanatory diagram schematically showing one example of such a carry-out carry-in mechanism. The carry-out carry-in mechanism of this example comprises a first conveyer 41 and a second conveyer 43 each of which can convey a setter in a direction perpendicular to the conveying direction of the return conveyer 9. The first conveyer 41 is provided with detection means (not shown) for detecting the ID numbers allocated to the setters 7. The first conveyer 41 is disposed overlapping part of the return conveyer 9, while the second conveyer 43 is disposed adjacently to the first conveyer 41 on the side of the return conveyer 9.

The deteriorated setter 7 is first detected by virtue of the ID number allocated thereto by the detection means of the first conveyer 41 or another detection means provided in another position on the circuit line, and thus detected ID Number is registered as an ID number of a setter to be removed from the circuit line. Then, when the setter 7 allocated this registered ID number moves on the circuit line to reach the loader 19, the loader 19 conveys the setter 7 in question into the upper passage 11 as it is, i.e. without placing a PDP glass substrate 5 thereon.

The setter 7 in question which has passed the upper passage 11 and moved onto the return conveyer 9 in the lower passage 13, is detected by virtue of thus registered ID number by the detection means of the first conveyer 41. After confirmation of agreement of the detected ID number with said registered ID number, the setter 7 in question is conveyed by the first conveyer 41 in the direction perpendicular to the conveying direction of the return conveyer 9 and delivered onto the adjacent second conveyer 43 so as to be removed from the circuit line.

On the other hand, those setters whose ID numbers detected by the detection means of the first conveyer 41 do not agree with the foregoing registered ID number are conveyed toward the outlet 17 as they are by the return conveyer 9. A new setter substituting for the setter removed from the circuit line is conveyed by the second conveyer 43 in a direction opposite to the direction upon removal, and introduced onto the circuit line at a position at which the return conveyer 9 overlaps with the first conveyer 41.

A PDP glass substrate can be effectively protected from re-adhesion of abrasion powder adhered onto the setter, and the layout of the installation of the system can be effectively attained. This is because the removal of a deteriorated setter and introduction of a substitute setter can be done at a position outside the clean room by providing such a carry-out carry-in mechanism.

Figure 6:
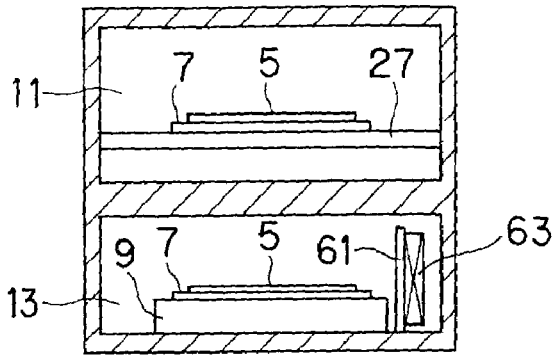
FIG. 6 is an explanatory diagram showing a conventional installation state of a control panel.
Figure 7:
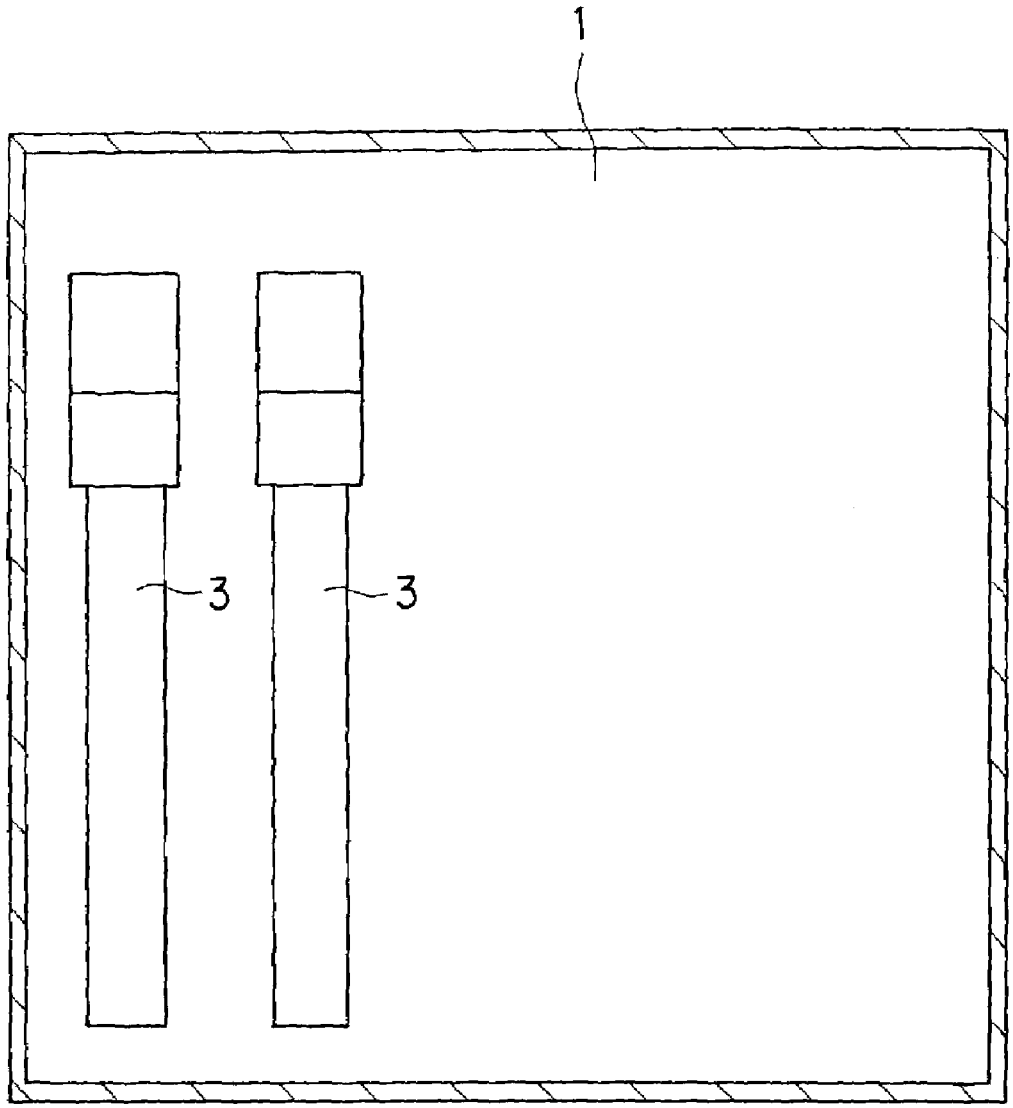
FIG. 7 is an explanatory diagram showing a conventional layout method for a baking furnace for a plasma display panel.

On the other hand, a control panel 63 comprising a fixed type mounting plate 61 and various electrical control units having been mounted on the surface of the mounting plate 61 are often installed on the side of the return conveyer 9 in the lower passage 13 for the further reduction in the installation space as shown in FIG. 6, in the case of the conventionally used PDP baking furnace. However, the mounting plate 61 with the control panel 63 becomes a hindrance for the maintenance operation when the maintenance operation of the return conveyer 9 is required within the lower passage 13 due to the occurrence of failure in the return conveyer 9.

Figure 5A:
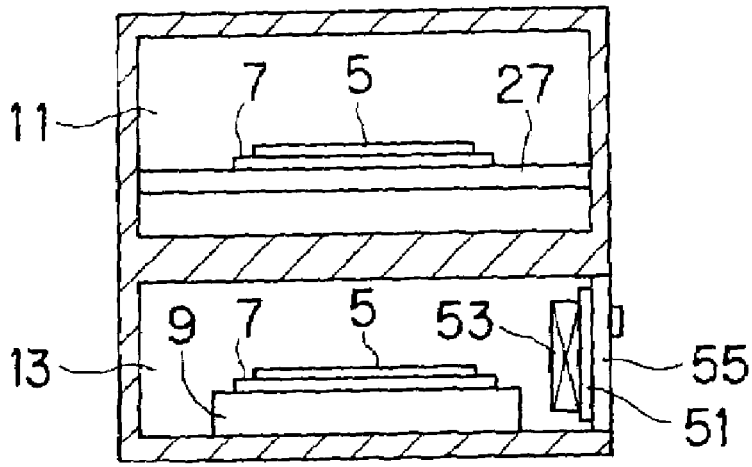
Figure 5B:
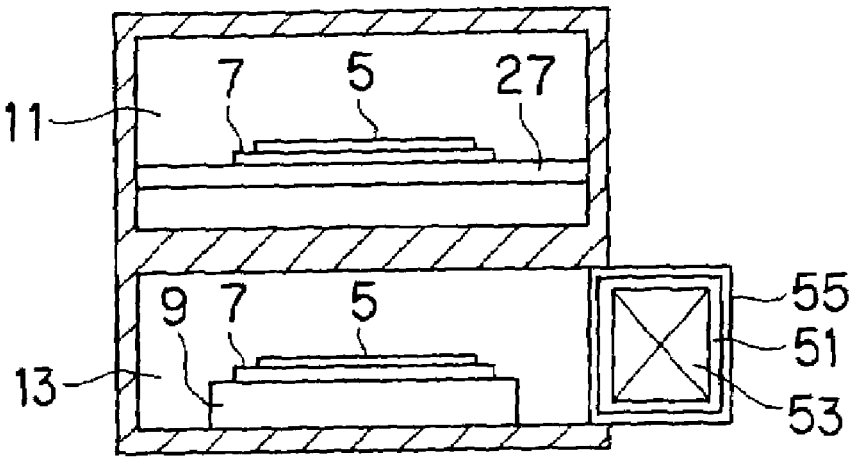

Therefore, in the PDP baking furnace used in the baking system and the layout method thereof according to the present invention, it is desirable that an open/close hinged door 55 is provided at a side wall portion of a thermal shield plate covering the whole furnace, and a mounting plate 51 and a control panel 53 like the mounting plate 61 and the control panel 63 are attached to the back side of the open/close door 55 as shown in FIG. 5A. With this structure, in the state where the open/close door 51 is open as shown in FIG. 5B, a maintenance operation of the return conveyer 9 can be easily done within the lower passage 13 without being hindered by the control panel 53. Further, since the control panel 53 is pulled out to the exterior of the lower passage 13, a maintenance operation of the electrical control units mounted on the control panel 53 can also be easily done.

As described above, according to the present invention, a space of the clean room necessary for baking the PDP glass substrates can be greatly reduced as compared with the conventional one and, as a result, the initial and running cost of the clean room can also be largely reduced. Further, since the maintenance operation of the furnace can be done outside the clean room, it is possible to prevent contamination of the clean room due to dust that is generated upon performing the maintenance operation.

What is claimed is:

1. A baking system for plasma display panel comprising a baking furnace for a plasma display panel; said furnace having an upper passage for conveying a plural number of plasma display panel glass substrates placed on respective setters while baking the substrates during conveying and a lower passage for conveying thus baked plasma display panel glass substrates during conveying in the upper passage in a direction opposite to the conveying direction of the substrates for baking in the upper passage, and further being provided with an inlet for introducing the plasma display panel glass substrates into the upper passage and an outlet for carrying out the baked plasma display panel glass substrates from the lower passage at the same end thereof, and a clean room, characterized in that only the inlet and the outlet are connected to the clean room, but a body of the baking furnace is disposed outside the clean room.

2. A system according to claim 1, wherein said baking furnace is further provided with a carry-out carry-in mechanism for conveying a setter in a direction perpendicular to the conveying direction of a return conveyer so as to carry out a setter on said return conveyer to the exterior of the baking furnace and carry in a new setter onto said return conveyer from the exterior of the baking furnace.

3. A layout method for a baking system for a plasma display panel comprising a baking furnace for a plasma display panel; said furnace having an upper passage for conveying a plural number of plasma display panel glass substrates placed on respective setters while baking the substrates during conveying and a lower passage for conveying thus baked plasma display panel glass substrates during conveying in the upper passage in a direction opposite to the conveying direction of the substrates for baking in the upper passage, and further being provided with an inlet for introducing the plasma display panel glass substrates into the upper passage and an outlet for carrying out the baked plasma display panel glass substrates from the lower passage at the same end thereof, and a clean room, characterized in that said system is arranged so as to connect only said inlet and said outlet with a clean room, while keeping a body of the baking furnace outside said clean room.

4. A layout method according to claim 3, wherein said baking furnace is further provided with a carry-out carry-in mechanism for conveying a setter in a direction perpendicular to the conveying direction of return conveyer so as to carry out a setter on said return conveyer to the exterior of the baking furnace and carry in a setter onto said return conveyer from the exterior of the baking furnace.

* * * * *